US006098202A

United States Patent [19]

Peck

[11] Patent Number: 6,098,202

[45] **Date of Patent: *Aug. 8, 2000**

[54] BELTLOOP JEWELRY ARTICLE

[76] Inventor: William M Peck, 824 Forest Ave. Apt. D-2, Evanston, Ill. 60202

[ * ] Notice: This patent issued on a continued prosecution application filed under 37 CFR 1.53(d), and is subject to the twenty year patent term provisions of 35 U.S.C. 154(a)(2).

[21] Appl. No.: 09/175,680

[22] Filed: Oct. 20, 1998

[51] Int. Cl.[7] ..... A41D 27/08

[52] U.S. Cl. ..... 2/244; 2/300; 2/309; 63/3; 63/3.1; 63/4; 63/21

[58] Field of Search ..... 63/1.18, 3, 3.1, 63/4, 21, 24, 25; 2/227, 236, 300, 309, 311, 313, 314, 315, 244

[56] References Cited

U.S. PATENT DOCUMENTS

| | | | |
|---|---|---|---|
| 301,491 | 7/1884 | Gibbons | 63/21 X |
| 437,678 | 10/1890 | Colby | 2/315 |
| 808,576 | 12/1905 | Roberts | 2/314 |
| 878,122 | 2/1908 | Costello | 63/4 |
| 897,405 | 9/1908 | Richmond | 2/227 |
| 1,155,032 | 9/1915 | Baer | 63/24 X |
| 1,271,554 | 7/1918 | Fane | 2/300 |
| 1,616,215 | 2/1927 | Chilson | 63/3 X |
| 2,218,932 | 10/1940 | Collins | 70/456 |
| 2,228,686 | 1/1941 | Bezault | 63/4 X |
| 2,236,207 | 3/1941 | Bowder | 24/232 |
| 2,482,386 | 9/1949 | Vaisey et al. | 24/239 |
| 2,707,285 | 5/1955 | Tino | 24/299 X |
| 4,095,587 | 6/1978 | Ishikawa | 128/1.3 |
| 4,501,026 | 2/1985 | Seneca | 2/308 |
| 4,858,425 | 8/1989 | Cheredaryk et al. | 59/80 |
| 4,885,805 | 12/1989 | Mason | 2/244 |
| 5,644,935 | 7/1997 | Jonovich et al. | 63/4 |
| 5,669,242 | 9/1997 | Cayton | 63/21 |
| 5,797,145 | 8/1998 | Levinson | 2/244 |
| 5,946,728 | 9/1999 | Tane | 63/3 X |
| 6,006,365 | 12/1999 | Strandberg | 2/329 |
| 6,026,515 | 2/2000 | Nielson et al. | 2/244 |

FOREIGN PATENT DOCUMENTS

| | | | |
|---|---|---|---|
| 26019 | 11/1902 | United Kingdom | 63/21 |
| 645658 | 11/1950 | United Kingdom | 63/3 |

*Primary Examiner*—Terry Lee Melius
*Assistant Examiner*—Andrea Chop
*Attorney, Agent, or Firm*—Emrich & Dithmar

[57] ABSTRACT

A jewelry article includes a plurality of beads and/or trinkets coupled together to form an elongated, flexible, decorative member having a clasp at each end thereof. Each clasp is adapted for fastening to a beltloop of the pants, jeans, shorts, skirt, or any other type of clothing with beltloops of a wearer permitting the jewelry article to be suspended from the waist and worn on the hip or across the front or back of the wearer.

6 Claims, 1 Drawing Sheet

BELTLOOP JEWELRY ARTICLE

FIELD OF THE INVENTION

This invention relates generally to articles of jewelry and is particularly directed to an article of jewelry to be worn adjacent the waist of a wearer by attaching the article to and suspending it from a pair of belt loops of the wearer's pants, jeans, shorts, skirt, or any other type of clothing with beltloops.

BACKGROUND OF THE INVENTION

Personal jewelry may take on various forms such as rings, bracelets, necklaces and ear rings. Each of these jewelry articles is worn on a particular part of the wearer's body having a naturally retentive shape such as the neck, wrist, ankle and even the waist. Other types of jewelry articles such as medals and broaches are attached to the wearer's clothing. These latter types of articles also include keychains and pocket watches which are suspended from a beltloop of the wearer and are generally stored in a pocket of the wearer.

The present invention represents a departure from prior personal jewelry articles by providing a jewelry article adapted for wearing on or adjacent to the waist of the wearer by attaching the article to the beltloops of the wearer's pants, jeans, shorts, skirt, or any other type of clothing with beltloops.

OBJECTS AND SUMMARY OF THE INVENTION

Accordingly, it is an object of the present invention to provide an article of jewelry to be worn on or adjacent to the waist of the wearer by suspending the article from the beltloops of the wearer's pants, jeans, shorts, skirt, or any other type of clothing with beltloops.

This invention contemplates a jewelry article adapted to be worn from the waist of a person wearing clothing having a plurality of waist beltloops, the jewelry article comprising an elongated, flexible member including a plurality of connected decorative elements; and first and second clasps each attached to a respective end of the elongated, flexible member and engaging first and second beltloops, respectively, for suspending the jewelry article on a hip or across the front or back of the person.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawing, where like reference characters identify like elements throughout the various figures, in which:

DETAILED DESCRIPTION OF THE PREFERRED EMBODIMENT

Figure 1:
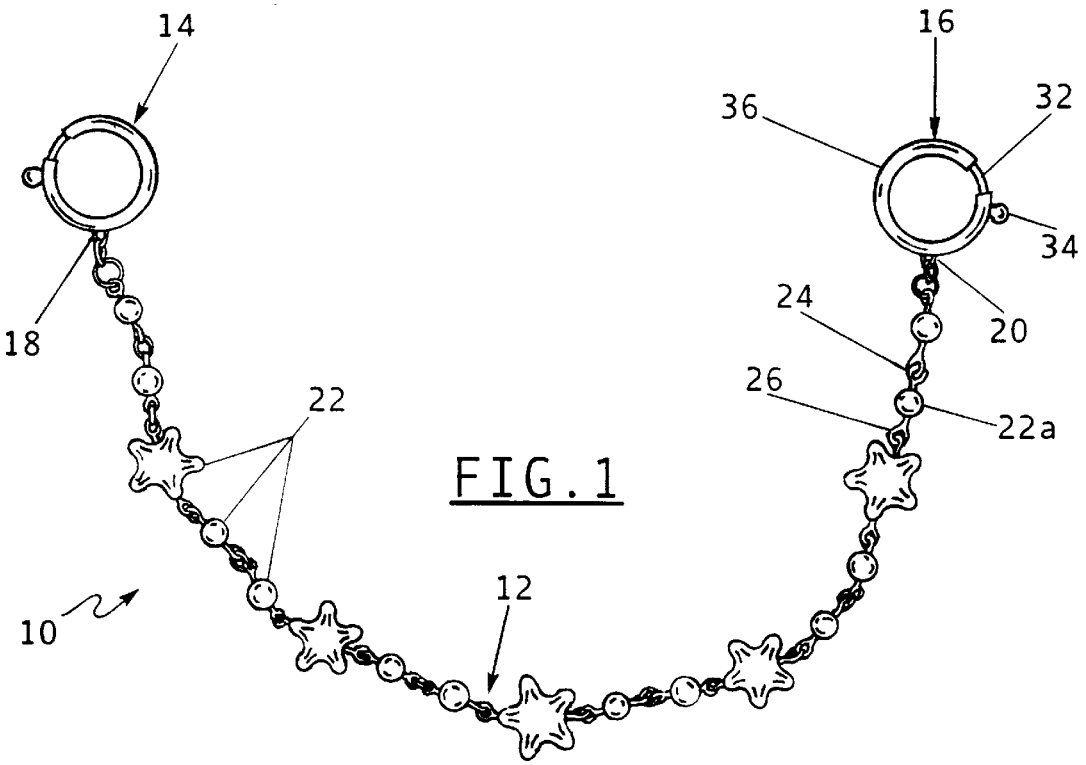
FIG. 1 is a plan view of a beltloop jewelry article in accordance with the present invention.

Referring to FIG. 1, there is shown a plan view of a beltloop jewelry article 10 in accordance with the present invention. The beltloop jewelry article 10 includes a center, or inner, portion 12 and first and second end clasps 14 and 16 disposed on respective ends of the center portion. Center portion 12 is comprised of a plurality of beads or trinkets 22 connected in a manner so as to form a continuous, elongated, flexible, decorative member. As shown for the case of bead 22*a,* each of the beads or trinkets is attached to a coupling element having first and second fasteners 24 and 26 on opposed ends thereof. Each of the coupling elements is attached to a pair of adjacent elements by means of the aforementioned fasteners so as to form the continuous, elongated, flexible center portion 12 of the beltloop jewelry article 10. The center portion 12 of the beltloop jewelry article 10 as shown in FIG. 1 is comprised of a plurality of spherical beads and star-shaped trinkets, but the beltloop jewelry article is not limited to the use of these types of decorative elements or fasteners, and may make use of virtually any type of decorative element or any combination of different types of decorative elements and fasteners.

Disposed on respective ends of the article's center portion 12 are the aforementioned first and second end clasps 14 and 16. The first end clasp 14 is connected to one end of the article's center portion 12 by means of a first jump ring 18, while the second end clasp 16 is connected to the opposing end of the center portion by means of a second jump ring 20. Although jump rings 18 and 20 are shown connecting the first and second end clasps 14,16 to the article's center portion 12, other types of conventional connecting devices and arrangements may be used equally as well in attaching the end clasps to the article's center portion.

Figure 2:
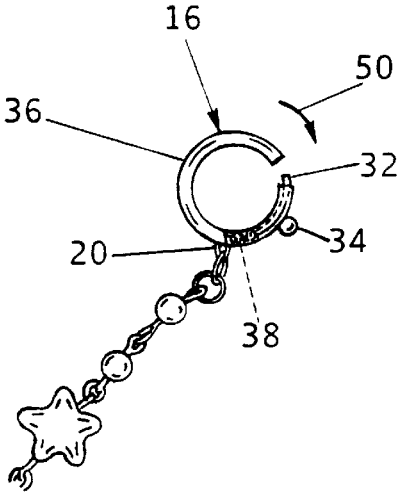
FIG. 2 is a partial plan view of the beltloop jewelry article of FIG. 1 showing additional details of the article's end clasp.

Referring to FIG. 2, the operation of each of the end clasps will now be described in terms of the second end clasp 16 shown in the figure, it being understood that both end clasps are identical in configuration and operation. The second end clasp 16 includes a hollow toroidal portion 36 having a section cut out therefrom. Extending across the cut out section of the hollow toroidal portion 36 is a movable insert pin 32. The movable insert pin 32 is urged to the closed position wherein it extends across the gap in the hollow toroidal section 36 by biasing means such as a coil spring 38 (shown in dotted line form) which is disposed within the clasp's hollow toroidal portion. The movable insert pin 32 is curvilinear in shape so as to conform with and fit within the clasp's hollow toroidal portion 36. Attached to the movable insert pin 32 is a tab 34 for manually moving the insert pin in the direction of arrow 50 to the retracted position in which it is no longer disposed across the gap in the hollow toroidal portion. In this retracted position, the movable insert pin 32 is retracted within the clasp's hollow toroidal portion 36.

Figure 3:
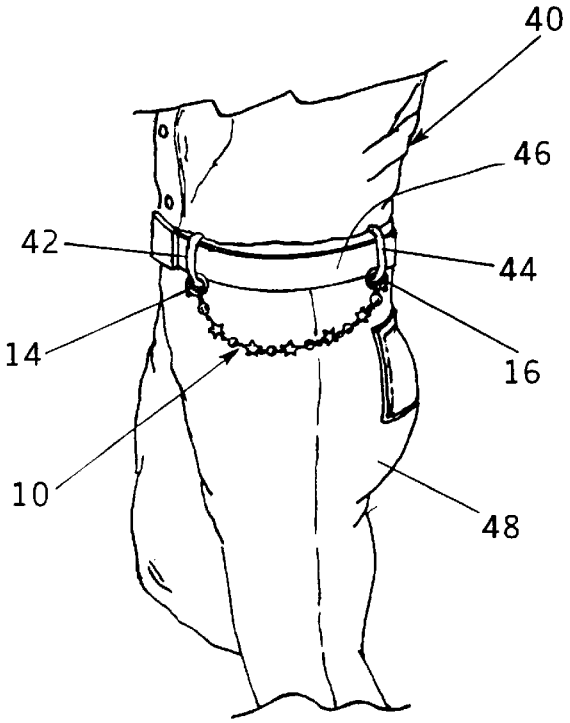
FIG. 3 shows the beltloop jewelry article of the present invention attached to and suspended from a pair of beltloops of the wearer's trousers.

Referring to FIG. 3, there is shown the manner in which the beltloop jewelry article 10 of the present invention is attached to and suspended from a pair of beltloops of a person 40 wearing the article. The person 40 is also wearing trousers 48, which may also be shorts, a skirt, or any other type of clothing with beltloops for purposes of the present invention. As is conventional, trousers 48 include a plurality of spaced beltloops disposed about the waist of the person 40 wearing the trousers, where two of the beltloops are shown as elements 42 and 44 in the figure. The first and second end clasps 14,16 disposed at respective ends of the beltloop jewelry article 10 are adapted for attachment to beltloop 42 and 44, respectively. As shown in FIG. 3, the beltloop jewelry article 10 is positioned on the hip of the person 40 wearing the article. The beltloop jewelry article 10 may similarly be attached to and suspended from front beltloops so as to be disposed across the front of the person 40 wearing the article. The beltloop jewelry article 10 would not interfere with a belt 46 inserted within beltloops 42 and 44, if worn, and may be of such length so as not to restrict or hinder access by the wearer to pockets in the trousers, shorts or skirt. First and second spring-loaded end clasps 14,16 on respective ends of the beltloop jewelry article 10 allow the jewelry article to be easily attached to and removed from the beltloops 42,44 without disturbing or removing the belt 46 from the waist of the wearer.

There has thus been shown a beltloop jewelry article including a plurality of beads and/or trinkets coupled together to form a continuous, elongated, flexible, decorative member. The jewelry article further includes first and second end clasps attached to respective ends of the elongated, flexible member and adapted for attachment to a respective beltloop of the wearer. The end clasps are easily attached to and removed from the beltloops without disturbing or removing the wearer's belt, if present. The jewelry article is suspended from the wearer's beltloops so as to be positioned on a hip of the wearer or across the front or back of the wearer.

While particular embodiments of the present invention have been shown and described, it will be obvious to those skilled in the art that changes and modifications may be made without departing from the invention in its broader aspects. For example, while spring-loaded end clasps, commonly known as "spring rings," are disclosed for attaching the jewelry article to a wearer's beltloops, virtually any type of releasable securing device could be used for attaching the jewelry article to a wearer's beltloops. Therefore, the aim in the appended claims is to cover all such changes and modifications as fall within the true spirit and scope of the invention. The matter set forth in the foregoing description and accompanying drawing is offered by way of illustration only and not as a limitation. The actual scope of the invention is intended to be defined in the following claims when viewed in their proper perspective based on the prior art.

I claim:

1. A jewelry article and garment combination adapted to be worn from the waist of a person, said jewelry article and garment combination comprising:

a garment having a plurality of beltloops disposed in a spaced manner;

a single, elongated, flexible member having a length and including a plurality of connected decorative elements, including beads and trinkets; and first and second clasps each attached to a respective end of said single, elongated, flexible member, wherein said first and second clasps are each attached to a respective beltloop for suspending the jewelry article only by means of said first and second clasps on a hip or across the front or back of the person, wherein said single, elongated, flexible member is loosely suspended from and positioned below the beltloops and is unattached to anything else along its length.

2. The jewelry article and garment combination of claim 1 wherein each of said first and second clasps includes a closed position for engaging a beltloop and an open position for releasing a beltloop, wherein said clasps are urged to said closed position.

3. The jewelry article and garment combination of claim 2 further comprising biasing means for urging said clasps to said closed position.

4. The jewelry article and garment combination of claim 3 wherein said biasing means includes a coil spring.

5. The jewelry article and garment combination of claim 3 further comprising means for manually overcoming said biasing means and moving the clasp from the closed to the open position.

6. The jewelry article and garment combination of claim 5 wherein said means for manually overcoming said biasing means includes a tab.

* * * * *